US007114193B2

(12) United States Patent
Winningham

(10) Patent No.: US 7,114,193 B2
(45) Date of Patent: Oct. 3, 2006

(54) TRIGGER FINGER PROTECTIVE GLOVE

(75) Inventor: Matthew Winningham, Birmingham, MI (US)

(73) Assignee: Warrior Lacrosse, Inc., Warren, MI (US)

( * ) Notice: Subject to any disclaimer, the term of this patent is extended or adjusted under 35 U.S.C. 154(b) by 0 days.

(21) Appl. No.: 10/908,650

(22) Filed: May 20, 2005

(65) Prior Publication Data

US 2005/0268373 A1 Dec. 8, 2005

Related U.S. Application Data

(60) Provisional application No. 60/572,678, filed on May 20, 2004.

(51) Int. Cl.
*A41D 19/00* (2006.01)

(52) U.S. Cl. ..... 2/163; 2/159; 2/161.1

(58) Field of Classification Search ..... 2/159, 2/16, 161.6, 161.1, 163, 160
See application file for complete search history.

(56) References Cited

U.S. PATENT DOCUMENTS 4,894,868 A * 1/1990 Christopher ..... 2/161.6
5,459,883 A * 10/1995 Garceau-Verbeck ..... 2/161.1
5,787,506 A 8/1998 Wilder et al.
6,209,137 B1 * 4/2001 Wallick ..... 2/161.1
6,405,380 B1 * 6/2002 Kuroda et al. ..... 2/161.1
6,550,069 B1 4/2003 Morrow
6,625,815 B1 * 9/2003 Litke ..... 2/161.2
6,681,402 B1 * 1/2004 Bevier et al. ..... 2/19
2004/0010834 A1 * 1/2004 Sidio ..... 2/16
2004/0060096 A1 * 4/2004 Thiruppathi ..... 2/161.1

OTHER PUBLICATIONS deBeer "Response" Glove (2004).
deBeer "Tropic" Glove (2004).
deBeer "Arctic" Glove (2004).
Brine "Half-Finger" Glove (2004).
Brine "Winter" Glove (2004).
Brine "Performance" Glove (2004).
Brine "Elite" Glove (2004).
Brine "Element" Glove (2004).
STX "Reflex" Glove (2004).
STX "Winter" Glove (2004).
STX "3/4 Finger" Glove (2004).

* cited by examiner

*Primary Examiner*—John J. Calvert
*Assistant Examiner*—Richale L. Haney
(74) *Attorney, Agent, or Firm*—Artz & Artz, PC

(57) ABSTRACT

A protective glove for protecting a wearer's hand includes a thumb pocket and an index finger pocket. The glove is designed to receive the wearer's thumb in the thumb pocket and the wearer's index finger in the index finger pocket, while leaving the user's other fingers exposed. The thumb pocket and the index finger pocket are attached to an adjustable wrist strap. Further, the thumb pocket and the index finger pocket are attached to each other.

8 Claims, 1 Drawing Sheet

TRIGGER FINGER PROTECTIVE GLOVE

CROSS-REFERENCE TO RELATED APPLICATION

The present invention claims priority from U.S. Provisional Patent Application Ser. No. 60/572,678, filed May 20, 2004, and entitled "Trigger Finger Protective Glove."

TECHNICAL FIELD

The present invention generally relates to protective sports gloves and, particularly to protective sports gloves for use by participants in the sport of lacrosse. More specifically, the present invention relates to a protective glove that is lighter, provides more ventilation, and is more mobile than conventional protective gloves.

BACKGROUND OF THE INVENTION

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play. While the gloves are intended to provide protection, players also desire gloves that maximize flexibility such that the player can flex his hand in a relatively unrestricted fashion and also manipulate the stick as required.

In the sport of lacrosse, checking includes wacking or hitting a player's stick with another player's stick in an effort to disrupt their ability to control the ball or puck. Checking in this fashion to dislodge the ball from another player's lacrosse head is an accepted part of the game in men's lacrosse. Accordingly, more padding or protection is desirable and typically utilized in protective gloves intended for men's lacrosse. While checking is not permitted in women's lacrosse, some degree of protection is still desired. This is because lacrosse is a contact sport and a player's stick can still contact another's hand in women's lacrosse, just not to the same degree of frequency as occurs in men's lacrosse. Thus, the amount of padding necessary or desired for women's lacrosse is not the same as required for men's lacrosse.

Lacrosse is a sport that is primarily played in the spring and summer months. Due to the increase in temperature and humidity during these months, ventilation of a player's hands is also a desirable feature. Accordingly, protective sports gloves have been made with openings formed in the padded back of the glove to allow ventilation of the wearer's hand by allowing air circulation. See, for example, U.S. Pat. No. 5,787,506. Further, other protective sports gloves have been formed with mesh openings in the leather palm that allow further air circulation to the wearer's hand. See, for example, U.S. Pat. No. 6,550,069. Faced with these competing concerns, lacrosse players seek a glove that provides coverage to protect vulnerable areas on their hands, but still provides improved ventilation and mobility.

SUMMARY OF THE INVENTION

It is, therefore, an advantage of the present invention to provide a protective sports glove that provides increased ventilation.

It is a further advantage of the present invention to provide a protective sports glove that provides increased mobility.

It is another advantage of the present invention to provide a protective sports glove that is intended for use by women in the game of lacrosse.

It is still another advantage of the present invention to provide a protective sports glove that allows a player to have increased feel.

It is yet another advantage of the present invention to provide a protective sports glove that provides protection for a player's hands in the areas where it is most vulnerable.

It is still a further advantage of the present invention to provide a protective sports glove that is configured as "Trigger Finger" where a wearer's thumb and index finger are covered with the other fingers being exposed.

In accordance with the above and the other advantages of the present invention, a protective sports glove is provided. The glove covers at least two, but less than all, of the wearer's fingers. This configuration, which leaves some fingers uncovered, allows the wearer to have a better grip on the lacrosse stick. Further, coverage is provided in the areas most vulnerable on the hands of a player. It is known that in women's lacrosse most cuts and bruises occur on the top of the wearer's hand and, in particular, between the thumb and the index finger. This can occur, for example, when a player gets checked on the top of the hand by another player. This can also occur, when a player takes a shot and upon following through hits the index finger and/or thumb on another player's stick.

More specifically, the protective sports glove covers only a wearer's index finger, a thumb, a portion of the wearer's palm, and a portion of the back of the wearer's hand opposite the palm. The disclosed glove includes a wrist strap that secures the glove to the wearer's hand, including, an index finger pocket and a thumb pocket. The wearer's other fingers remain uncovered. The glove also includes numerous openings for improved ventilation. There is at least one opening on the palm side of the glove and at least one opening on the back side of the glove.

These and other features of the present invention will become apparent from the following description of the invention, when viewed in accordance with the accompanying drawings and appended claims.

BRIEF DESCRIPTION OF THE DRAWINGS

The present invention will be described by way of example with reference to the following drawings.

DETAILED DESCRIPTION OF THE PREFERRED EMBODIMENT

Figure 1:
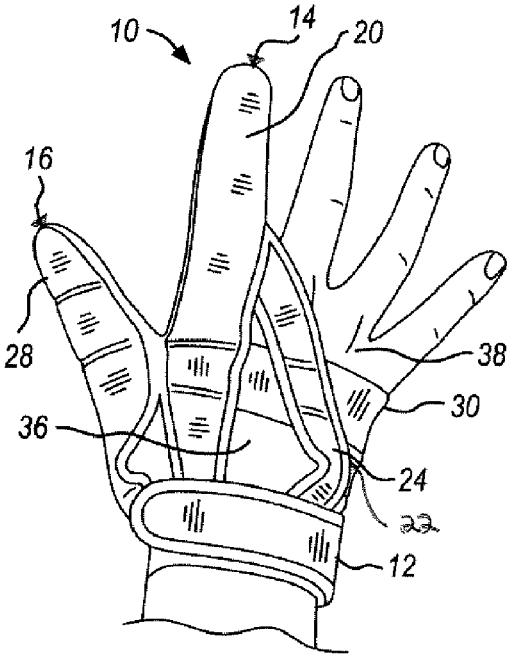
FIG. 1 illustrates a back side view of a protective sports glove in accordance with one embodiment of the present invention.
Figure 2:
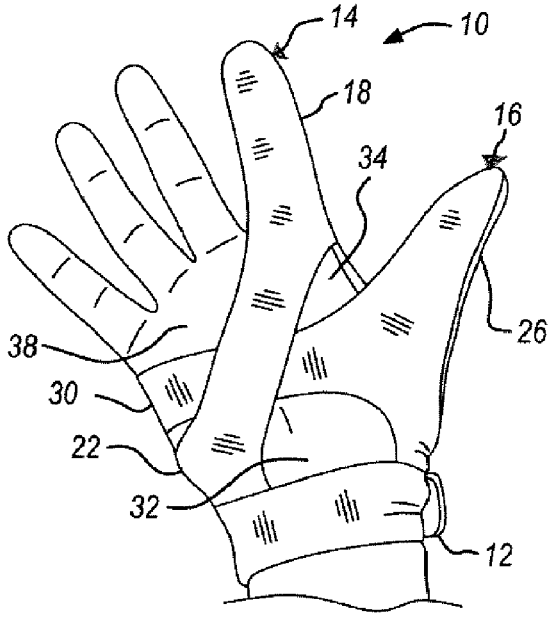
FIG. 2 illustrates a palm side view of the glove illustrated in FIG. 1.

Referring to FIGS. 1 and 2, which illustrate a protective glove 10 in accordance with one embodiment of the present invention. The protective glove is preferably for use in women's lacrosse, but may be utilized in a variety of other sports or applications. As shown, the protective glove 10, includes a wrist strap 12, an index finger pocket 14, which is intended to receive a wearer's finger, and a thumb pocket 16, which is intended to receive a wearer's thumb. The index finger pocket 14 and the thumb pocket 16 are preferably constructed of a cloth material. However, they may be constructed of a variety of other suitable materials.

The index finger pocket 14 and the thumb pocket 16 are both preferably attached to the wrist strap 12 at their respective lower ends. Further, the index finger pocket 14 and the thumb pocket 16 are also preferably attached to each other. Thus, in accordance with one embodiment, when a wearer is wearing the glove 10, the wearer's index finger and thumb are covered by the glove 10, while the wearer's remaining fingers are exposed or uncovered to provide increased grip by those fingers as well as increased breathability and ventilation to the hand. It will be understood that while the glove 10 in this embodiment, only covers two fingers, more or less fingers may be covered. For example, the pinkie could also be covered. Alternatively some or all of the fingers may be partially covered, such as by a half pocket. Thus, the fingers may consist of a combination of pockets and half pockets.

The index finger pocket 14 receives a wearer's index finger when in use. In general, the index finger pocket 14 includes a palm portion 18 and a back side portion 20. The palm portion 18 of the index finger pocket 14 is adjacent to the palm side of the wearer's index finger when in use. The back side portion 20 of the index finger pocket 14 is adjacent to the opposite side of the wearer's hand or, in other words, the back of the wearer's finger. The index finger pocket 14 also includes a first index finger strap 22 and a second index finger strap 24.

The second index finger strap 24 extends generally from a connection with the index finger back portion 20 to a connection with the wrist strap 12. The second index finger strap 24 lies adjacent to the back of the wearer's hand when in use. The first index finger strap 22 is also referred to as a first side strap. The first index finger strap 22 extends generally from a connection with the index finger palm portion 18 around the side of the wearer's hand to an attachment with the second index finger strap 24. The first index finger strap 22 is preferably formed of an elastic material. The first index finger strap 22 and the second index finger strap 22 assist in retaining the glove 10 securely on the wearer's hand.

The thumb pocket 16 receives a wearer's thumb when being worn and includes a thumb palm portion 26, a thumb back portion 28, and a thumb strap 30. Similar to the index finger pocket 14, the thumb palm portion 26 is located adjacent to the wearer's palm when in use while the thumb back portion 28 is located adjacent to the back of the wearer's thumb.

The thumb strap 30, which is also referred to as the second side strap, extends generally from a connection with the thumb pocket palm portion 26 around the wearer's hand and to an attachment with the thumb pocket back portion 28. In one embodiment, the thumb strap 30 begins at the location where it contacts the index finger palm portion 18. The thumb strap 30 is also preferably attached to both the second index finger strap 24 and the index finger front portion 20. Obviously, the thumb strap 30 can take on a variety of different configuration and orientations.

In one embodiment, the second side strap 30 is made from an elastic material and helps the glove fit snugly on the wearer's hand. It will be understood that the side straps 22, 30 may be constructed of other materials as desired. The first side strap 22 may be narrower than the second side strap 30. The various sections of the glove 10 can be attached to each other by a number of different methods, including, but not limited to, sewing them together and gluing them together. Further, the glove 10 may have more or less straps as desired. Additionally, the straps may take on a variety of different sizes, shapes, and configurations.

The wrist strap 12 preferably extends completely around the wearer's wrist when in use and is adjustable to secure the protective glove 10 and maintain it on the wearer's hand. The wrist strap 12 is preferably constructed of an elastic material. The wrist strap 12 includes a pair of releasable ends that allow for adjustment of the strap allowing the wearer to tighten the strap 12 to a desired tension around the wearer's wrist as desired. In one embodiment, the wrist strap 12 is adjustable via the use of VELCRO®, which is also known as hook and loop attachment. While this is the preferred attachment mechanism, other suitable attachments mechanisms may be utilized.

The protective glove 10 includes numerous openings for improved ventilation in both the palm and the back. Specifically, there is at least one opening on the palm side of the glove 10 and at least one opening on the back side of the glove 10. In other words, when the glove 10 is being worn, there are exposed areas of the wearer's hand due to the open design of the protective glove 10 for the purposes of ventilation. On the palm side of the glove 10, there is a first open area 32 defined or bordered by the thumb pocket palm portion 26, the thumb pocket strap 30, the index finger palm portion 18, and the wrist strap 12. There is a second open area 34, also on the palm side of the glove 10, which is defined or bounded by the thumb pocket palm portion 26, the thumb pocket strap 30, the index finger palm portion 18, and the index finger back portion 20. There is a third open area 35 depending upon the size of the straps and how they are configured. The third open area 35 is located near the pinkie side of the hand and is defined or bounded by the thumb pocket strap 30 and the first side strap 22.

On the back side of the glove 10, there is a fourth open area 36 defined or bounded by the index finger pocket front portion 20, the thumb strap 30, the index finger second strap 24, and the wrist strap 12. There is a fifth open area 37 defined or bounded by the thumb pocket back portion 28, the index finger back portion 20, and the wrist strap 12.

There is another open area 38, extending across both the back and palm portions of the glove 10, which is defined by the index finger pocket palm portion 18, the thumb pocket strap 30, and the index finger second strap 24. This open area 38 exposes a portion of the wearer's palm, a portion of the back of the hand, a portion of the palm of the hand, and the remainder of the wearer's fingers. In other words, the three fingers included in the open area 38 are not covered by any portion of the glove 10. The material of the glove in the palm is preferably oriented such that it covers or protects the high use areas or areas where a player movably holds or grips a lacrosse stick. In other words, the openings are, therefore, preferably formed in the non-high use areas.

The index finger back portion 20, the index finger second strap 24, and the thumb back portion 28 all preferably have padding 40 to protect vulnerable areas of the wearer's hand. Alternatively, instead of a padded material 40 these portions may be constructed of other materials that provide protection to these portions of a wearer's hand. It will be understood that other portions of the glove 10 may have padded or protective material formed thereon. Further, there may be sections with mesh in the non-high use areas in the palm of the glove to provide a wearer with additional ventilation.

Figure 3:
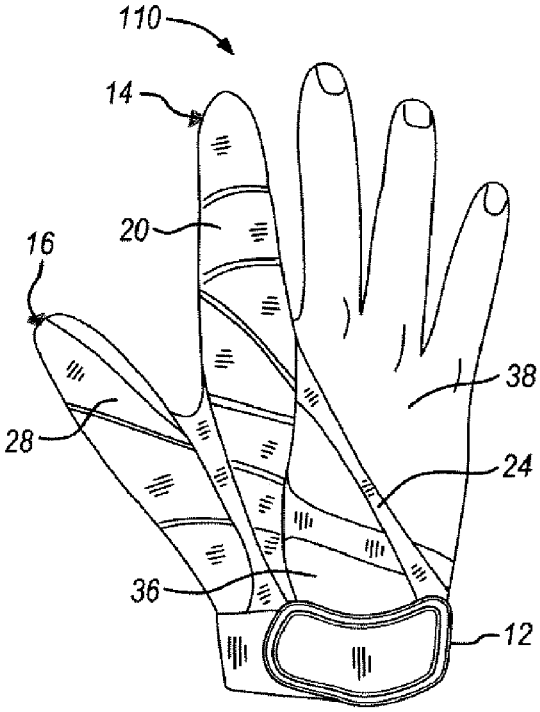
FIG. 3 illustrates a back side view of a protective sports glove in accordance with another embodiment of the present invention.
Figure 4:
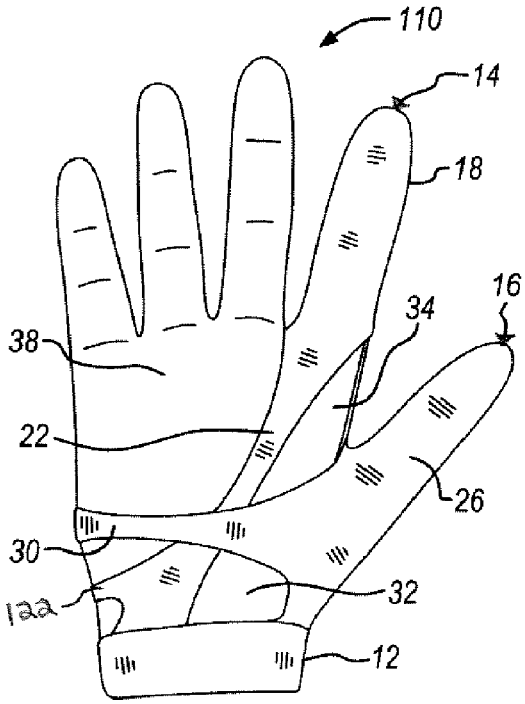
FIG. 4 illustrates a palm side view of the glove illustrated in FIG. 3.

FIGS. 3 and 4 illustrate an alternative embodiment of the protective glove, which is generally identified by reference number 110. One difference between the two embodiments is the attachment of the index finger strap 22. In the first embodiment, the index finger strap or first side strap 22 could be a separate piece of material that is attached to and extends between both the index finger palm portion 18 and the second index finger strap 24. In the alternative embodiment, the index finger strap 122 is a section extending from the same piece of material that defines the index finger palm portion 18.

It is to be understood that while a glove that can be worn on a wearer's right hand is shown in FIGS. 1–4, the present invention also includes a glove that can be worn on a wearer's left hand. The glove for use on a wearer's left hand would be a mirror image of the glove shown in FIGS. 1–4.

While the present invention has been described in what is presently considered to be its most practical and preferred embodiment or implementation, it is also to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A protective glove for a wearer's hand, comprising:

a wrist strap;

a thumb pocket attached to said wrist strap for receiving a wearer's thumb;

an index finger pocket attached to said wrist strap and said thumb pocket for receiving a wearer's index finger, wherein said index finger pocket includes a palm portion and a back portion, and wherein said index finger pocket has a first index finger strap and a second index finger strap secured thereto to assist in retaining the glove on the wearer's hand; and a back portion having protective padding therein to protect a back of the wearer's hand;

a thumb strap extending from said palm portion of said thumb pocket to said back portion of said thumb pocket to assist in retaining the glove on the wearer's hand, wherein said thumb strap is attached to said index finger palm portion, said second index finger strap and said index finger front portion;

wherein at least two of the wearer's fingers remain uncovered and at least two other open areas are defined in the glove by said thumb pocket and said index finger pocket; and wherein said thumb pocket palm portion, said thumb pocket strap, said index finger palm portion and said wrist strap define a first open area.

2. The protective glove of claim 1, wherein said thumb pocket palm portion, said thumb pocket strap, said index finger palm portion, and said index finger front portion define a second open area.

3. The protective glove of claim 2, wherein said index finger pocket front portion, said thumb strap, said index finger second strap, and said wrist strap define a third open area.

4. The protective glove of claim 3, wherein said wrist strap is adjustable to allow a wearer to tighten the glove as desired.

5. A protective glove for use by a wearer during the sport of lacrosse, the protective glove comprising:

a wrist strap that generally circumscribes a wearer's hand for securing the protective glove to the wearer's hand;

an index finger pocket attached to said wrist strap for receiving a wearer's index finger, wherein said index finger pocket includes a palm portion attached to said wrist strap, a back portion attached to said wrist strap, an index finger strap, and a second index finger strap, wherein said second index finger strap extends from said back portion of said index finger pocket to said wrist strap, and said index finger strap extends from said palm portion of said index finger pocket around the wearer's hand to said second index finger strap;

a thumb pocket attached to said wrist strap for receiving a wearer's thumb, wherein said thumb pocket includes a palm portion attached to said wrist strap, a back portion attached to said wrist strap, and a thumb strap extending from said palm portion of said thumb pocket around the wearer's hand to said back portion of said thumb pocket and is attached to said second index finger strap and said index finger front portion; and wherein the remainder of the wearer's fingers remain uncovered.

6. The protective glove of claim 5, wherein said wrist strap is adjustable.

7. The protective glove of claim 5, wherein said wrist strap consists of an elastic material.

8. The protective glove of claim 5, wherein said index finger pocket front portion, said index finger second strap, and said thumb pocket front portion each include padding material for protecting the back of a wearer's hand.

* * * * *